US009816496B2

(12) United States Patent
Ott et al.

(10) Patent No.: US 9,816,496 B2
(45) Date of Patent: Nov. 14, 2017

(54) OSCILLATING ARMATURE PUMP WITH A FLUX-CONDUCTING ELEMENT

(71) Applicant: SYSKO AG, Chur (CH)

(72) Inventors: Hubert Ott, Ravensburg (DE); Norbert Helbling, Jona (CH)

(73) Assignee: SYSKO AG, Chur (CH)

( * ) Notice: Subject to any disclaimer, the term of this patent is extended or adjusted under 35 U.S.C. 154(b) by 0 days.

(21) Appl. No.: 15/306,499

(22) PCT Filed: Apr. 23, 2015

(86) PCT No.: PCT/EP2015/058841
§ 371 (c)(1),
(2) Date: Oct. 25, 2016

(87) PCT Pub. No.: WO2015/162221
PCT Pub. Date: Oct. 29, 2015

(65) Prior Publication Data

US 2017/0051731 A1 Feb. 23, 2017

(30) Foreign Application Priority Data

Apr. 25, 2014 (DE) ..... 10 2014 105 869

(51) Int. Cl.
*F04B 17/04* (2006.01)
*F04B 9/06* (2006.01)
(Continued)

(52) U.S. Cl.
CPC ..... *F04B 17/04* (2013.01); *F04B 9/06* (2013.01); *F04B 17/046* (2013.01); *F04B 53/146* (2013.01); *F04B 53/16* (2013.01)

(58) Field of Classification Search
CPC ..... F04B 17/04; F04B 17/046; H02K 33/02
See application file for complete search history.

(56) References Cited

U.S. PATENT DOCUMENTS 2,768,580 A * 10/1956 Parker ..... F04B 17/046 417/274
3,400,663 A * 9/1968 Wertheimer ..... F04B 17/046 417/417
(Continued)

FOREIGN PATENT DOCUMENTS

CH 447 818 A 11/1967
DE 1 937 184 U 4/1966
(Continued)

OTHER PUBLICATIONS

German Search Report dated Sep. 18, 2014 issued in corresponding DE patent application No. 10 2014 105 869.0 (and partial English translation).
(Continued)

*Primary Examiner* — Patrick Hamo
(74) *Attorney, Agent, or Firm* — Posz Law Group, PLC

(57) ABSTRACT

An oscillating armature pump, in particular high-pressure oscillating armature pump, for a household appliance, with a piston guidance for guiding a piston element, with a pump spring provided for supplying an actuation force onto the piston element, and with a housing unit comprising at least one flux-conducting element which is provided to conduct a magnetic flux generated by a magnetic actuator.
It is proposed that the flux-conducting element is in a mounted state arranged in a radial direction between the pump spring and the piston guidance.

17 Claims, 6 Drawing Sheets

Figure 1:
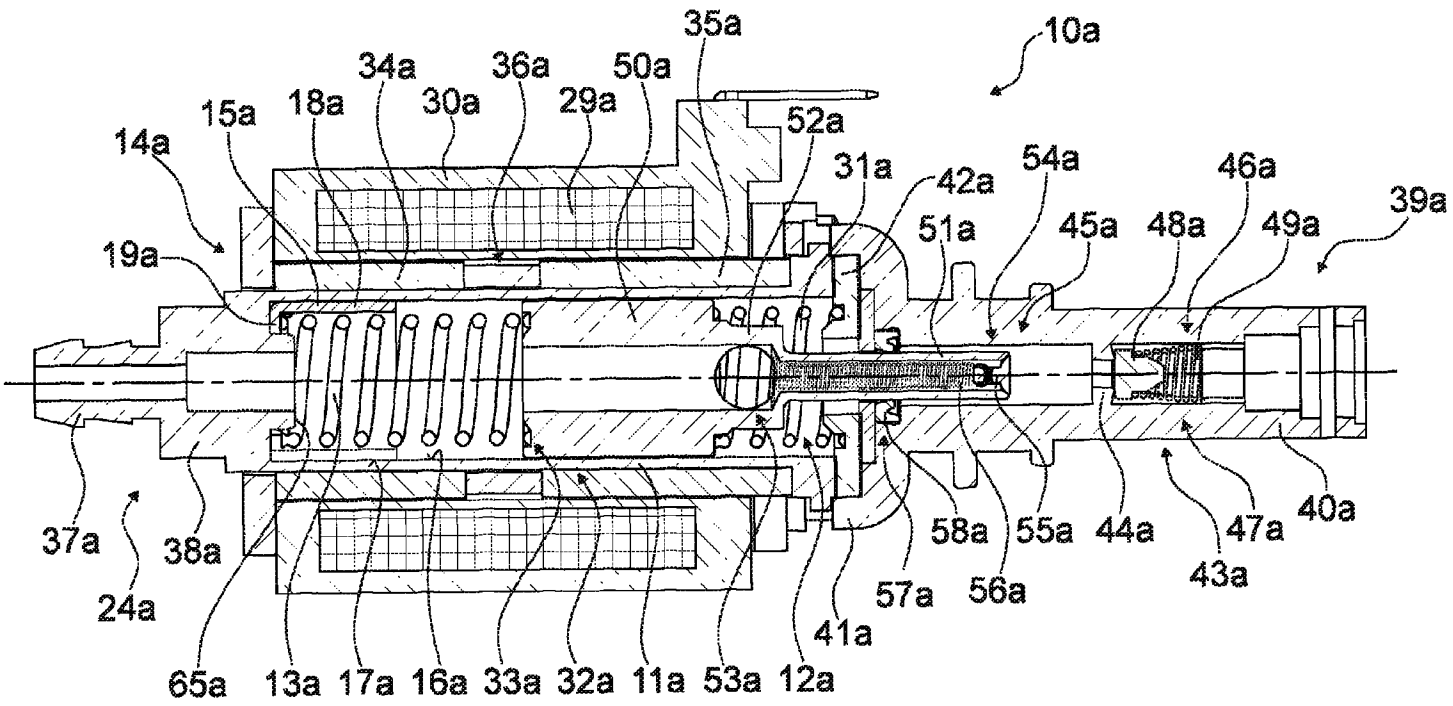

(51) Int. Cl.
*F04B 53/14* (2006.01)
*F04B 53/16* (2006.01)

(56) References Cited

U.S. PATENT DOCUMENTS

| | | | | | |
|---|---|---|---|---|---|
| 3,804,558 | A * | 4/1974 | Naito | H02K 33/02 | 417/417 |
| 4,047,852 | A * | 9/1977 | O'Connor | F02M 37/08 | 417/415 |
| 4,389,169 | A * | 6/1983 | De Dionigi | H02K 33/02 | 310/30 |
| 4,832,583 | A * | 5/1989 | Brown | F04B 53/129 | 318/484 |
| 5,073,095 | A * | 12/1991 | Thomas, Sr. | F04B 17/046 | 335/257 |
| 6,942,470 | B1 * | 9/2005 | Versini | A47J 31/4403 | 417/307 |
| 7,094,041 | B2 * | 8/2006 | Hashimoto | F04B 17/046 | 417/417 |
| 2013/0183174 | A1 * | 7/2013 | Hampton | F04B 17/04 | 417/410.1 |

FOREIGN PATENT DOCUMENTS

| | | | |
|---|---|---|---|
| DE | 195 44 029 | A1 | 5/1997 |
| DE | 603 08 440 | T2 | 9/2007 |
| DE | 60 2004 008 596 | T2 | 12/2007 |
| DE | 10 2011 078 850 | A1 | 1/2013 |
| DE | 10 2012 004 735 | A1 | 9/2013 |
| EP | 1 365 149 | B1 | 9/2006 |
| EP | 1 607 629 | B1 | 8/2007 |
| EP | 2 122 167 | B1 | 2/2011 |

OTHER PUBLICATIONS

International Search Report & Written Opinion of the International Searching Authority dated Jul. 13, 2015 issued in corresponding International Patent Application No. PCT/EP2015/058841 (and partial English translation).

International Preliminary Report on Patentability dated Oct. 27, 2016 issued in corresponding International Patent pplication No. PCT/EP2015/058841 (and English translation).

* cited by examiner

OSCILLATING ARMATURE PUMP WITH A FLUX-CONDUCTING ELEMENT

CROSS REFERENCE TO RELATED APPLICATIONS

This application is a U.S. national stage application of PCT/EP2015/058841 filed on Apr. 23, 2015, which is based on German Patent Application No. 10 2014 105 869.0 filed on Apr. 25, 2014, the contents of which are incorporated herein by reference.

STATE OF THE ART

The invention relates to an oscillating armature pump, in particular a high-pressure oscillating armature pump, for a household appliance.

From EP 2 122 167 an oscillating armature pump is already known, with a piston guidance for guiding a piston element, with a pump spring provided for supplying an actuation force onto the piston element, and with a housing unit comprising a flux-conducting element which is provided to conduct a magnetic flux generated by a magnetic actuator.

The objective of the invention is, in particular, to provide an especially effective oscillating armature pump. The objective is achieved, according to the invention, by the features of patent claim 1 while advantageous implementations and further developments of the invention may become apparent from the subclaims.

ADVANTAGES OF THE INVENTION

The invention is based on an oscillating armature pump, in particular a high-pressure oscillating armature pump, for a household appliance, with a piston guidance for guiding a piston element, with a pump spring provided for supplying an actuation force onto the piston element, and with a housing unit comprising a flux-conducting element which is provided to conduct a magnetic flux generated by a magnetic actuator.

It is proposed that the flux-conducting element is in a mounted state arranged in a radial direction between the pump spring and the piston guidance. This allows providing a particularly efficient oscillating armature pump. A magnetic coil for driving the oscillating armature pump can be designed of accordingly small dimensions, and a particularly cost-effective oscillating armature pump can be made available. A "housing unit" is in particular to be understood, in this context, as a unit which is arranged stationarily, which means that it is in particular immobile during a pumping process. Preferably the piston guidance has an inner surface shaped as a cylinder shell area, inside which the flux-conducting element is arranged. Preferentially the flux-conducting element is provided to at least temporarily increase a magnetic force onto the piston element. Especially preferentially the flux-conducting element is provided to at least temporarily attract the piston element. Preferably the flux-conducting element is arranged inlet-side with respect to the piston element. Preferentially the oscillating armature pump is provided for conveying a liquid and particularly preferably for conveying water. "Inlet-side" and "outlet-side" is in particular to be understood, in this context, with respect to a flow direction of the liquid that is to be conveyed by the oscillating armature pump. By a "magnetic actuator" is in particular to be understood, in this context, a device provided for converting an electric power into a mechanic power via a magnetic field. Indications regarding a direction, e.g. "axial", "radial" and "in a circumferential direction" are in particular to be understood, in this context, with respect to a motion axis of the piston element. "Provided" is in particular to mean specifically programmed, designed and/or equipped. By an object being provided for a certain function is in particular to be understood that the object fulfills and/or implements said certain function in at least one application state and/or operating state.

It is further proposed that the piston guidance and the flux-conducting element are connected in a friction-fit manner. This allows mounting the flux-conducting element and holding it in the oscillating armature pump particularly easily.

In an advantageous implementation the piston guidance comprises an inner wall and the flux-conducting element comprises an outer wall, which are situated adjacently to each other. This allows holding the flux-conducting element in the oscillating armature pump in an especially secure fashion. "Being situated adjacently to each other" is in particular to mean, in this context, that the inner wall and the other wall contact each other face-to-face. Preferably the outer wall of the flux-conducting element contacts the inner wall of the piston guidance at least substantially entirely, i.e. preferentially by 70%, preferably by 80% and particularly preferably by 90%.

Moreover it is proposed that the flux-conducting element comprises a base body and a plurality of feet which form at least partly a spring seat of the pump spring. As a result of this, the flux-conducting element can be arranged in the oscillating armature pump and can be held in its position by a tension force of the pump spring in a particularly secure fashion. By a "foot" is in particular to be understood, in this context, a molding in particular to an end of a structural element, which is provided to hold, support and/or fixate the structural element in an axial direction. Preferably the feet support the flux-conducting element against an inlet-side wall of the inner space of the pump. Preferentially the feet are embodied integrally with the flux-conducting element.

Advantageously the feet are oriented inwards with respect to the base body in a radial direction. This allows making a particularly compact flux-conducting element available.

In an advantageous embodiment the flux-conducting element is embodied as a bent piece of sheet metal, which is rolled up forming a sleeve. In this way a particularly cost-favorable flux-conducting element can be made available. Principally it is also conceivable that the flux-conducting element is produced in a different procedure, e.g. in a deep-drawing procedure.

Furthermore it is proposed that the base body of the flux-conducting element has an outer diameter, and a wall thickness amounting to maximally 10% of the outer diameter. As a result of this, a construction space can be used in a particularly effective fashion, in particular for arranging the pump spring. Preferably the wall thickness of the base body is no less than 0.5 mm, preferably 1.0 mm and particularly preferably no less than 1.5 mm. Preferentially an outer diameter of the base body is at least 10 mm, preferably at least 15 mm and especially preferably no less than 20 mm. Herein a ratio of the wall thickness to the outer diameter is preferentially maximally 10%, preferably no more than 8%.

In an advantageous implementation the flux-conducting element comprises at least one slot in an axial direction. As a result of this, a flux-conducting element can be made available particularly simply, which is provided for supplying a tension force in a radial direction. The slot is preferably implemented extending end-to-end in a radial and in an axial direction. Principally it is also conceivable that the flux-conducting element is embodied in a multi-part implementation.

It is also proposed that the housing unit comprises a further flux-conducting element, which is arranged radially inside the pump spring. As a result of this, a particularly effective housing unit and a particularly efficient oscillating armature pump can be made available. A further "flux-conducting element" is in particular to mean, in this context, an element provided to at least temporarily increase a magnetic force onto the piston element, analogously to the flux-conducting element. Principally it is also conceivable that the oscillating armature pump comprises the further flux-conducting element as an only flux-conducting element.

In an advantageous implementation, the flux-conducting elements at least partially encompass the pump spring between them in a radial direction in a mounted state. In this way a particularly compact housing unit can be provided. At least "partly" is in particular to mean, in this context, that the flux-conducting elements encompass at least one axial section of the pump spring between them in a radial direction. Preferably the axial section encompassed by the flux-conducting elements amounts to at least 30%, preferably 40%, and particularly preferentially no less than 50% of an axial extension of the pump spring in an idle state.

It is further proposed that the oscillating armature pump comprises a housing element, which is connected to the further flux-conducting element in a friction-fit fashion. As a result of this, the further flux-conducting element can be mounted and can be held in the oscillating armature pump particularly easily. Preferentially the housing element has an outer wall and the further flux-conducting element has an inner wall, which are in a mounted state connected to each other in a friction-fit manner.

Furthermore it is proposed that the further flux-conducting element comprises a base body and a plurality of feet, which embody at least partly a spring seat of the pump spring. In this way the flux-conducting element can be arranged in the oscillating armature pump and held by a tension force of the pump spring in an especially secure fashion.

Advantageously the feet are oriented outwards in a radial direction with respect to the base body. This allows using an existing construction space in a particularly effective manner, providing an especially compact housing unit.

In an advantageous embodiment the flux-conducting element comprises at least one fixating element, which is provided for holding the flux-conducting element in the piston guidance. As a result of this, a secure fixation of the flux-conducting element is achievable in a structurally simple fashion. By a "fixating element" is in particular, in this context, an element to be understood which is provided for a force-fit and/or form-fit connection of the flux-conducting element to at least one other element, preferably to at least one housing element. Preferentially the fixating element is provided for fixating the flux-conducting element in an axial direction. The at least one fixating element may in particular be embodied by a foot of the flux-conducting element. Preferentially the flux-conducting element comprises a plurality of fixating elements. Preferably the at least one fixating element is arranged in a cylindrical outer face of the flux-conducting element. This allows avoiding a negative impact on and/or damage to the piston guidance, in particular in a mounting process.

It is further proposed that the at least one fixating element is embodied integrally with the flux-conducting element. As a result of this, a structurally simple and/or cost-favorable flux-conducting element can be made available. "Implemented integrally" is in particular to mean, in this context, connected by substance-to-substance bond and/or formed in one piece, e.g. by manufacturing from one cast and/or by a production in a one-component or multi-component injection-molding procedure and advantageously from a single blank.

Advantageously the at least one fixating element is embodied as a clamping element. A particularly simple mounting process is achievable. Preferably the fixating element is provided to supply a clamping force between the flux-conducting element and at least one housing element. Preferentially the flux-conducting element comprises a plurality of fixating elements supplying clamping forces in substantially different directions. Preferably the directions of the clamping forces differ from each other by at least 45°, preferably by at least 90° and especially preferentially by at least 120°.

It is moreover proposed that the oscillating armature pump comprises a ring-shaped groove, which is provided for receiving the flux-conducting element. This allows advantageously centering the flux-conducting element in the piston guidance. Preferably the groove is arranged concentrically to a motion axis of the piston element. Preferentially a housing element of the oscillating armature pump comprises the groove. Preferably a width of the groove corresponds at least substantially to a wall thickness of the flux-conducting element.

DRAWINGS

Further advantages become apparent from the following description of the drawings. In the drawings an exemplary embodiment of the invention is shown. The drawings, the description and the claims contain a plurality of features in combination. Someone having ordinary skill in the art will purposefully also consider the features separately and will find further expedient combinations.

Figure 2:
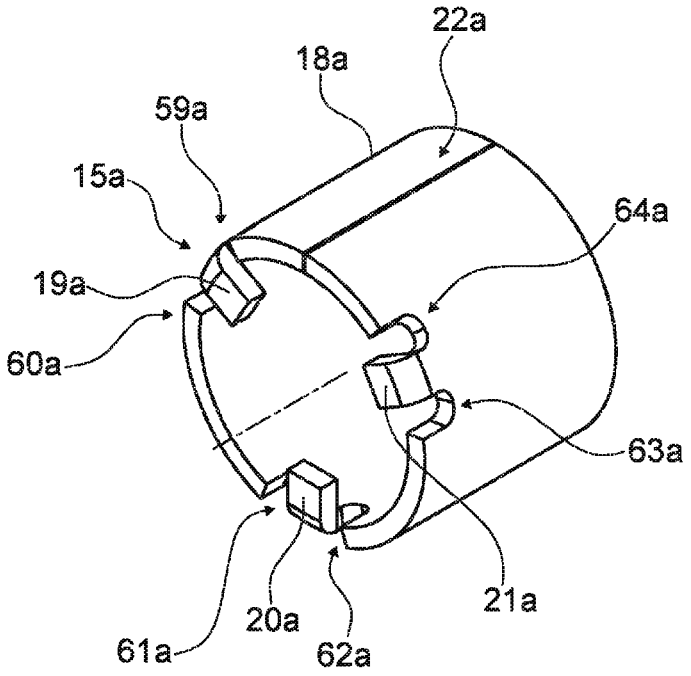
Figure 3:
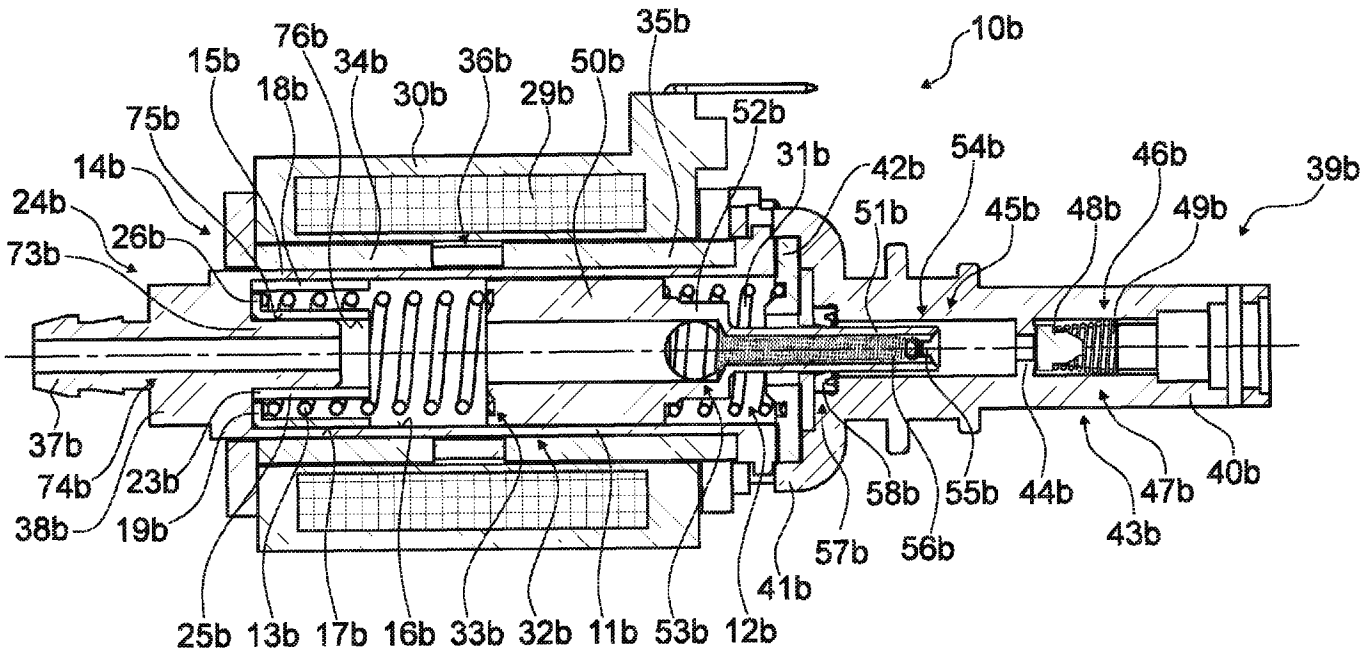
Figure 4:
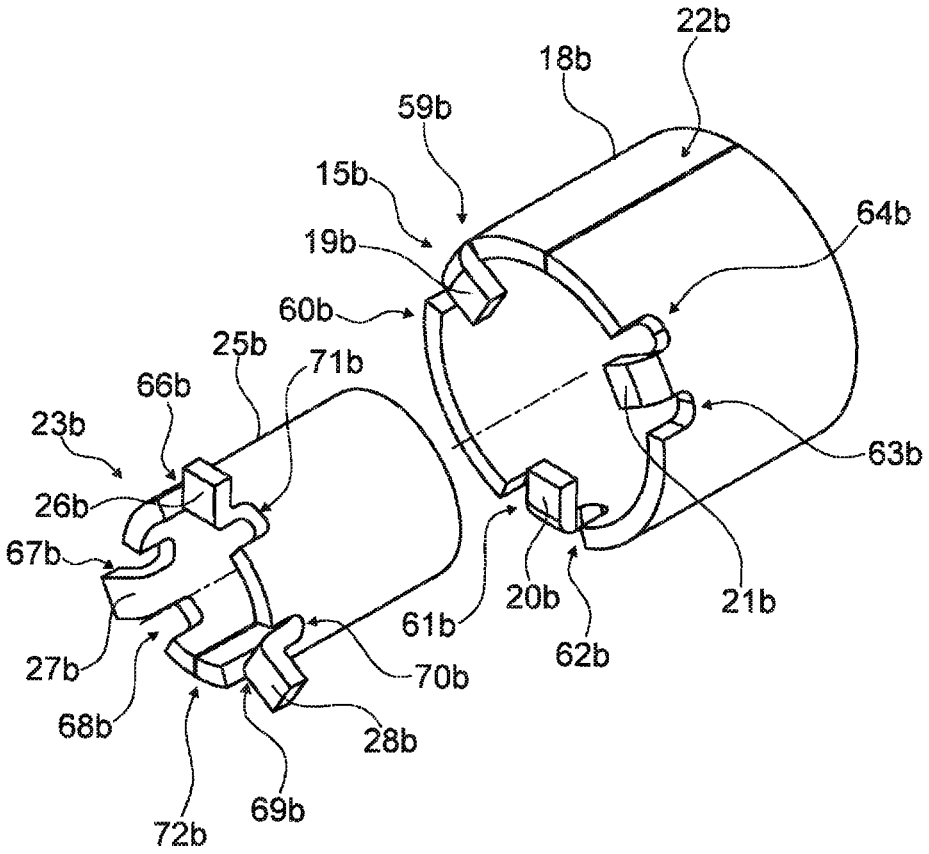
Figure 5:
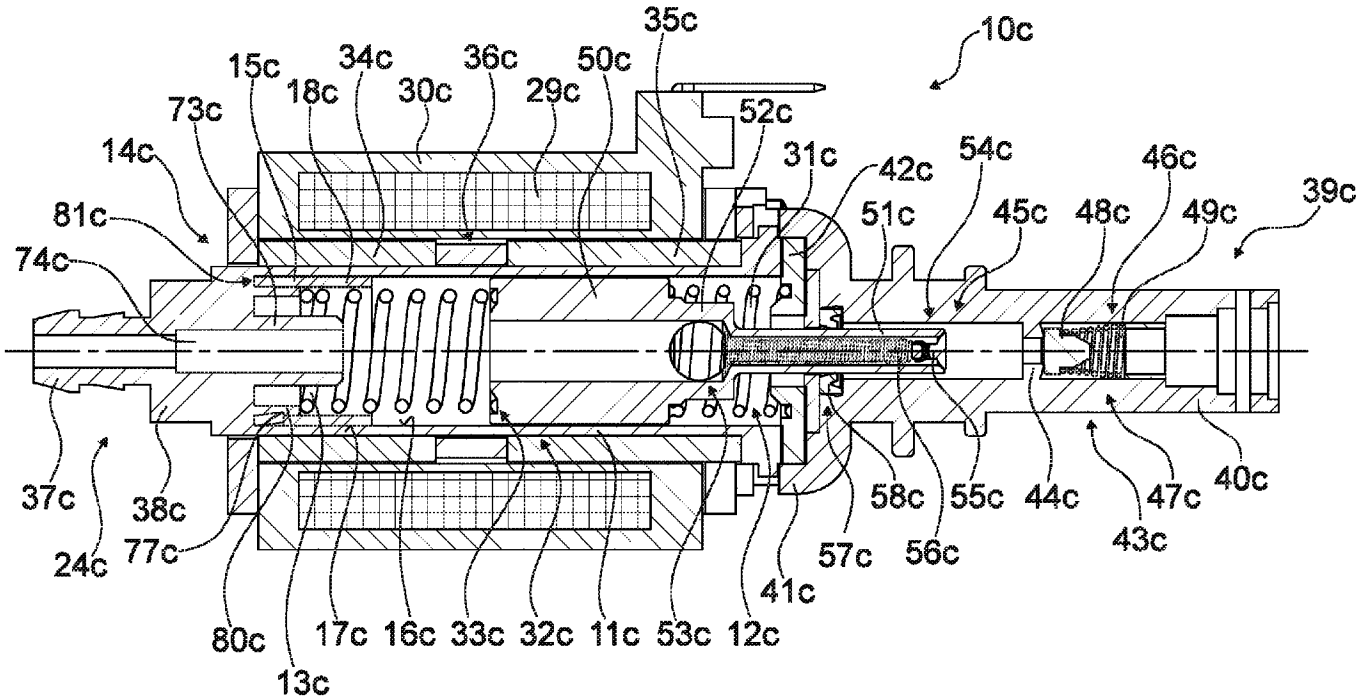
Figure 6:
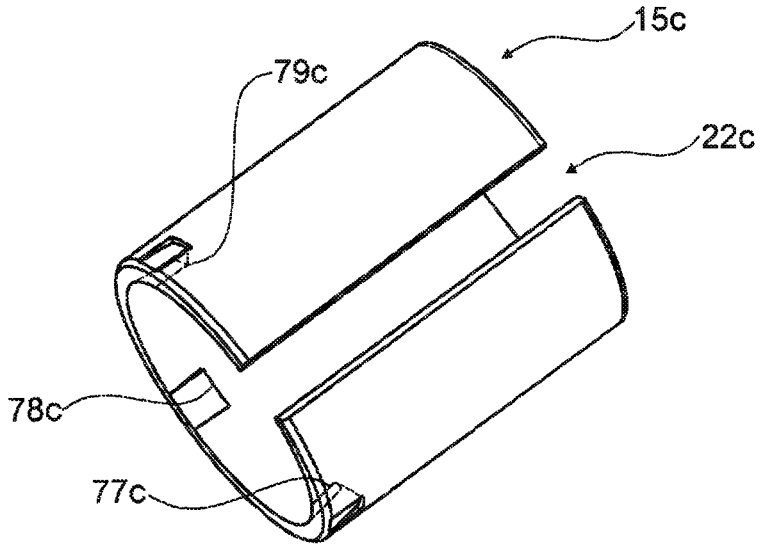

It is shown in:

FIG. 1 a longitudinal section through an oscillating armature pump,

FIG. 2 a perspective view of a flux-conducting element of the oscillating armature pump, FIG. 3 a longitudinal section through an oscillating armature pump for a further exemplary embodiment FIG. 4 an exploded drawing for two flux-conducting elements of the oscillating armature pump, FIG. 5 a longitudinal section through an oscillating armature pump for a further exemplary embodiment, and FIG. 6 a perspective view of a flux-conducting element of the oscillating armature pump.

DESCRIPTION OF THE EXEMPLARY EMBODIMENTS

FIGS. 1 and 2 show an oscillating armature pump 10*a* for a household appliance. The oscillating armature pump 10*a* is provided for conveying a liquid, e.g. water, at a pressure of at least 10 bar. In particular when the oscillating armature pump 10*a* is used in a coffee machine, there may occur a counter pressure of more than 15 bar.

The oscillating armature pump 10*a* comprises a magnetic actuator having a magnetic coil 29*a*, a coil housing 30*a* and a piston element 12*a*. The oscillating armature pump 10*a* further comprises a pump spring 13*a* acting onto the piston element 12*a* and a damper spring 31*a*. Moreover the oscillating armature pump 10*a* comprises a piston guidance 11*a* extending through the coil housing 30*a* with the magnetic coil 29*a* and encompassing an inner pump space, in which the piston element 12*a* is guided in an axially movable fashion. The piston guidance 11*a* is in the shown embodiment implemented separately from the coil housing 30*a*. The piston guidance 11*a* is embodied as an elongate cylinder. The oscillating armature pump 10*a* comprises a prechamber 32*a*, which is in the present embodiment encompassed by the piston guidance 11*a*. The piston guidance 11*a* itself may be embodied in a multi-part implementation. The pump spring 13*a* is embodied as a helical compression spring and is supported between the piston guidance 11*a*, which is fixedly connected to the coil housing 30*a*, and the piston element 12*a*. The piston element 12*a* comprises a ring-shaped groove 33*a* which forms an outlet-side spring seat of the pump spring 13*a*. The groove 33*a* is arranged spaced apart from an outer circumference of the piston element 12*a*.

The magnetic coil 29*a* is provided for generating a magnetic field that partly permeates the inner pump space. For the purpose of directing the magnetic field, the magnetic actuator comprises two pole piece elements 34*a*, 35*a*, between the ends of which a magnetically insulating gap 36*a* is arranged.

The oscillating armature pump 10*a* comprises a housing element 24*a*, which is implemented as an inlet element and is provided for a connection of a feed line for the liquid that is to be conveyed. The housing element 24*a* comprises a connecting fitting 37*a* and a flange body 38*a*. In the present embodiment the housing element 24*a* is implemented integrally with the piston guidance 11*a*. The oscillating armature pump 10*a* further comprises an outlet element 39*a*, which is provided for a connection of an output line for the liquid that is to be conveyed. The outlet element 39*a* comprises a pressure chamber cylinder 40*a* and a flange body 41*a*. The oscillating armature pump 10*a* also comprises a sealing disk 42*a* delimiting the inner pump space on an outlet side and forming an outlet-side front face of the inner pump space. The sealing disk 42*a* is arranged in an axial direction between the piston guidance 11*a* and the outlet element 39*a*, and is in a mounted state inserted in the flange body 38*a* of the outlet element 39*a*.

The pressure chamber cylinder 40*a* implements a cylindrical pressure chamber 43*a* and has a necking 44*a*, which divides the pressure chamber 43*a*, in an axial direction, into a compression chamber 45*a* and a valve chamber 46*a*. The necking 44*a* protrudes into the pressure chamber 43*a* in an axial direction. In an operating state of the oscillating armature pump 10*a*, the liquid that is to be conveyed flows consecutively through the housing element 24*a* which is embodied as an inlet element, the prechamber 32*a*, the compression chamber 45*a* and the valve chamber 46*a*. The oscillating armature pump 10*a* comprises an outlet valve 47*a*, which is arranged in the valve chamber 46*a* of the outlet element 39*a*. The outlet valve 47*a* is embodied as a return valve having a pass-through direction from the compression chamber 45*a* to an outlet. The necking 44*a* forms a valve seat of the outlet valve 47*a*. The outlet valve 47*a* comprises an axially movably supported closure piece 48*a* and a closure spring 49*a* which, in a mounted state, presses the closure piece 48*a* against the valve seat.

The piston element 12*a* comprises an armature element 50*a* and a pressure piston element 51*a* as well as a transition element 52*a* connecting the armature element 50*a* to the pressure piston element 51*a*. The armature element 50*a* is entirely arranged in the prechamber 32*a* and is provided for converting a magnetic force into a mechanical force as a result of the magnetic field generated by the magnetic coil 29*a*. For achieving a pumping effect, a pulse-wise voltage is applied to the magnetic coil 29*a*, resulting in a perpetually changing magnetic field in a region of the inner pump space. The pulse-wise changing magnetic field causes the piston element 12*a* being deflected with an increasing strength of the magnetic field, firstly from its idle state counter to the force of the pump spring 13*a*. The piston element 12*a* bridges a magnetic flux in a vicinity of the gap 36*a* between the pole piece elements 34*a*, 35*a*. If the magnetic field is at its maximum, the piston element 12*a* is maximally deflected. As soon as a current through the magnetic coil 29*a* is reduced and hence the strength of the magnetic field drops, the piston element 12*a* is moved back towards its idle position by the force of the pump spring 13*a*. Herein a diode unit is preferably connected previously to the magnetic coil 29*a*, such that merely a half-wave of an AC voltage is applied to the magnetic coil 29*a*. In the exemplary embodiment shown the magnetic coil 29*a* is provided for an AC voltage of 230 V at 50 Hz.

The damper spring 31*a* is provided for damping a movement of the piston element 12*a* at a turning point between a compression stroke and an intake stroke. The damper spring 31*a* is embodied as a helical compression spring. The damper spring 31*a* is spatially arranged axially between the armature element 50*a* and the sealing disk 42*a* that is inserted in the outlet element 39*a*. The pump spring 13*a*, the piston element 12*a* and the damper spring 31*a* are arranged coaxially to a motion axis of the piston element 12*a*. The armature element 50*a* and the sealing disk 42*a* each form a spring seat of the damper spring 31*a*. Principally it is also conceivable that the oscillating armature pump 10*a* comprises no damper spring 31*a*. The turning point between a compression stroke and an intake stroke is in this case determined by the liquid that is to be conveyed.

The armature element 50*a* is implemented in a shape of a hollow cylinder and has an outer diameter and an inner diameter. The inner diameter is a bit more than a third of the outer diameter. The transition element 52*a* directly follows the armature element 50*a* on an outlet side and has an outer diameter that is smaller than the outer diameter of the armature element 50*a*. The piston element 12*a* has in a region of the transition element 52*a* two cut-outs 53*a*, which are provided for a liquid exchange between the two axial sides of the armature element 50*a*.

The pressure piston element 51*a* directly follows the transition element 52*a* on an outlet side and has an outer diameter which is once more reduced with respect to the outer diameter of the transition element 52*a*. The pressure piston element 51*a* comprises a piston valve 54*a*, which is arranged, in terms of flow, between the prechamber 32*a* and the compression chamber 45*a*. The piston valve 54*a* is embodied as a return valve having a pass-through direction from the prechamber 32*a* into the compression chamber 45*a*. The piston valve 54*a* comprises a closure piece 55*a* and a closure spring 56*a*. The closure piece 55*a* is arranged on an outlet-side end of the pressure piston element 51*a*. In an intake stroke, in which the piston element 12*a* is moved through the magnetic field counter to the force of the pump spring 13*a*, liquid flows from the prechamber 32*a* into the compression chamber 45*a* through the piston valve 54*a*. In a subsequent compression stroke, in which the piston element 12*a* is moved by the force of the pump spring 13*a*, the liquid is pressed out of the compression chamber 45*a*. The maximum pressure herein acting onto the liquid depends in particular on the force of the pump spring 13*a*. A displacement by which the piston element 12*a* is herein moved depends on a configuration of the oscillating armature pump 10*a*. In a mounted state the pressure piston element 51*a* engages into the compression chamber 45*a*. The outlet element 39*a* comprises a sealing zone 57*a* between the prechamber 32*a* and the compression chamber 45*a*. The sealing zone 57*a* comprises a sealing element 58*a*, which is provided for sealing an inner wall of the pressure chamber cylinder 40*a* against an outer wall of the pressure piston element 51*a* and for sealingly closing off the compression chamber 45*a* against the prechamber 32*a*.

The oscillating armature pump 10*a* comprises a housing unit 14*a* featuring a flux-conducting element 15*a*, which is provided to conduct a magnetic flux generated by the magnetic actuator. The flux-conducting element 15*a* is provided to vary a distribution of the magnetic field in a pump interior in a vicinity of a turning point between a compression stroke and an intake stroke of the piston element 12*a* and to increase a magnetic force onto the piston element 12*a*. The flux-conducting element 15*a* is provided to magnetically attract the piston element 12*a*. The flux-conducting element 15*a* is implemented of a magnetizable material. In the present exemplary embodiment the flux-conducting element 15*a* is implemented of a magnetizable stainless steel.

The pump spring 13*a* is provided to supply a tension force delimiting a minimum distance between the flux-conducting element 15*a* and the piston element 12*a* in a turning point between a compression stroke and an intake stroke, which means that a movement of the piston element 12*a* is contact-free, and the piston element 12*a* is in the turning point arranged spaced apart from the flux-conducting element 15*a*. Principally it is also conceivable that the piston element 12*a* comprises, on its outer circumference on an inlet-side front face, a ring-shaped recess which is provided for partly receiving the flux-conducting element 15*a*, and that in the turning point the piston element 12*a* partly plunges into the flux-conducting element 15*a*.

The flux-conducting element 15*a* is in a mounted state arranged in a radial direction between the pump spring 13*a* and the piston guidance 11*a*. The pump spring 13*a* is arranged directly neighboring to the flux-conducting element 15*a* in a radial direction. The flux-conducting element 15*a* comprises a base body 18*a*, which is embodied as a hollow cylinder and comprises an outer wall 17*a*. The flux-conducting element 15*a* is arranged in the prechamber 32*a* of the oscillating armature pump 10*a* inlet-side in such a way that it is in an axial direction directly adjacent to the housing element 24*a*, which is embodied as an inlet element. The piston guidance 11*a* and the flux-conducting element 15*a* are connected to each other in a friction-fit manner. The piston guidance 11*a* comprises an inner wall 16*a*. The inner wall 16*a* of the piston guidance 11*a* and the outer wall 17*a* of the flux-conducting element 15*a* are situated adjacently to each other. The flux-conducting element 15*a* has a pretension pressing, in a mounted state, the outer wall 17*a* of the flux-conducting element 15*a* against the inner wall 16*a* of the piston guidance 11*a*.

The flux-conducting element 15*a* comprises at its front-side edge three feet 19*a*, 20*a*, 21*a*, which partly form an inlet-side spring seat of the pump spring 13*a*. The feet 19*a*, 20*a*, 21*a* respectively embody a fixation element. The feet 19*a*, 20*a*, 21*a* are provided for fixating the flux-conducting element 15*a* in an axial direction. Principally it is conceivable that the flux-conducting element 15*a* comprises a greater number of feet. In a mounted state the edge featuring the feet 19*a*, 20*a*, 21*a* faces toward an inlet of the oscillating armature pump 10*a*. The pump spring 13*a* is in contact with the feet 19*a*, 20*a*, 21*a* of the flux-conducting element 15*a* and presses the flux-conducting element 15*a* against the housing element 24*a* which is embodied as an inlet element, towards the inlet. In the present exemplary embodiment the feet 19*a*, 20*a*, 21*a* are implemented as tongues protruding beyond the base body 18*a* on an inlet side (cf. FIG. 2). The flux-conducting element 15*a* comprises, at its edge featuring the feet 19*a*, 20*a*, 21*a* and respectively directly next to the feet 19*a*, 20*a*, 21*a*, respectively two U-notches 59*a*, 60*a*, 61*a*, 62*a*, 63*a*, 64*a*. The feet 19*a*, 20*a*, 21*a* and the U-notches 59*a*, 60*s*, 61*a*, 62*a*, 63*a*, 64*a* are respectively implemented analogously with respect to each other. The feet 19*a*, 20*a*, 21*a* are arranged evenly distributed over a circumference of the flux-conducting element 15*a* at an angular distance of 120 degrees. The feet 19*a*, 20*a*, 21*a* are oriented inwards in a radial direction with respect to the base body 18*a*. The feet 19*a*, 20*a*, 21*a* are bent inwards in the radial direction. Principally it is conceivable that the flux-conducting element 15*a* is embodied without feet 19*a*, 20*a*, 21*a* and has a smooth edge on an inlet side. It is also conceivable that the flux-conducting element 15*a* comprises at its inlet-side edge a ring having a ring plane that is situated perpendicularly to the axial direction.

The housing element 24*a*, which is embodied as an inlet element, comprises a guiding ring 65*a* on its flange body 38*a*. The guiding ring 65*a* is arranged centrally at the flange body 38*a* and protrudes into the prechamber 32*a*. The guiding ring 65*a* is arranged coaxially to the motion axis of the piston element 12*a* and is provided for centering the pump spring 13*a* and holding it in a radial direction on the inlet side. An outer circumference of the guiding ring 65*a* corresponds to an inner circumference of the pump spring 13*a*. In a mounted state the ends of the feet 19*a*, 20*a*, 21*a* of the flux-conducting element 15*a* are in contact with the guiding ring 65*a*.

The flux-conducting element 15*a* is embodied as a bent piece of sheet metal, which is rolled up forming a sleeve. The base body 18*a* has an outer diameter, and a wall thickness that amounts to approximately 7% of the outer diameter. The wall thickness is in the present exemplary embodiment approximately 1 mm. The flux-conducting element 15*a* comprises a straight slot 22*a* in an axial direction. The slot 22*a* is implemented end-to-end in an axial and in a radial direction.

In FIGS. 3 to 6 two further exemplary embodiments of the invention are shown. The following descriptions are substantially limited to the differences between the exemplary embodiments wherein, regarding structural elements, features and functions that remain the same, the description of the exemplary embodiment of FIGS. 1 and 2 may be referred to. For distinguishing the exemplary embodiments, the letter a of the reference numerals of the exemplary embodiment in FIGS. 1 and 2 has been substituted by the letters b and c in the reference numerals of the exemplary embodiments of FIGS. 3 to 6. Concerning structural elements having the same denomination, in particular structural elements having the same reference numerals, principally the drawings and/or the description of the exemplary embodiment of FIGS. 1 and 2 may be referred to.

FIGS. 3 and 4 show an oscillating armature pump 10*b* which comprises, analogously to the previous exemplary embodiment, a magnetic actuator featuring a magnetic coil 29*b*, a coil housing 30*b* and a piston element 12*b*. Further the oscillating armature pump 10*b* comprises a pump spring 13*b* acting onto the piston element 12*b*, and a damper spring 31*b*. The oscillating armature pump 10*b* moreover comprises a piston guidance 11*b* extending through the coil housing 30*b* with the magnetic coil 29*b* and encompassing an inner pump space in which the piston element 12*b* is guided in an axially mobile fashion. The piston element 12*b* comprises a ring-shaped groove 33*b*, which forms an outlet-side spring seat of the pump spring 13*b*. The magnetic coil 29*b* is provided for generating a magnetic field partly permeating the inner pump space. For the purpose of directing the magnetic field, the magnetic actuator comprises two pole piece elements 34*b*, 35*b*, between the ends of which a magnetically insulating gap 36*b* is arranged.

The oscillating armature pump 10*b* comprises a housing element 24*b* which is embodied as an inlet element and is provided for a connection of a feed line for the liquid that is to be conveyed. The housing element 24*b* comprises a connecting fitting 37*b* and a flange body 38*b*. In the present exemplary embodiment the inlet element is embodied integrally with the piston guidance 11*b*. The oscillating armature pump 10*b* further comprises an outlet element 39*b*, which is provided for a connection of an output line for the liquid that is to be conveyed. The outlet element 39*b* comprises a pressure chamber cylinder 40*b* and a flange body 41*b*. The oscillating armature pump 10*b* also comprises a sealing disk 42*b*, which delimits the inner pump space on an outlet side and implements an outlet-side front face of the inner pump space. The sealing disk 42*b* is arranged in an axial direction between the piston guidance 11*b* and the outlet element 39*b* and is, in a mounted state, inserted in the flange body 38*b* of the outlet element 39*b*. The pressure chamber cylinder 40*b* implements a cylindrical pressure chamber 43*b* and comprises a necking 44*b* dividing, in an axial direction, the pressure chamber 43*b* into a compression chamber 45*b* and a valve chamber 46*b*. The necking 44*b* protrudes into the pressure chamber 43*b* in a radial direction. The oscillating armature pump 10*b* comprises an outlet valve 47*b* arranged in the valve chamber 46*b* of the outlet element 39*b*. The outlet valve 47*b* comprises an axially movably supported closure piece 48*b* and a closure spring 49*b* which, in a mounted state, presses the closure piece 48*b* against the valve seat.

The piston guidance 11*b* is embodied as an elongate cylinder. The oscillating armature pump 10*b* comprises a prechamber 32*b*, which is in the present exemplary embodiment encompassed by the piston guidance 11*b*. The piston element 12*b* comprises an armature element 50*b* and a pressure piston element 51*b* as well as a transition element 52*b* connecting the armature element 50*b* to the pressure piston element 51*b*. The piston element 12*b* comprises in a region of the transition element 52*b* two cut-outs 53*b*, which are provided for a liquid exchange between the two axial sides of the armature element 50*b*. The pressure piston element 51*b* comprises a piston valve 54*b* arranged, in terms of flow, between the prechamber 32*b* and the compression chamber 45*b*. The piston valve 54*b* comprises a closure piece 55*b* and a closure spring 56*b*. The closure piece 55*b* is arranged at an outlet-side end of the pressure piston element 51*b*. The outlet element 39*b* comprises a sealing region 57*b* in a transition zone between the prechamber 32*b* and the compression chamber 45*b*. The sealing region 57*b* comprises a sealing element 58*b*, which is provided for sealing an inner wall of the pressure chamber cylinder 40*b* against an outer wall of the pressure piston element 51*b*, and for sealingly closing off the compression chamber 45*b* against the prechamber 32*b*.

Analogously to the previous exemplary embodiment, the oscillating armature pump 10*b* comprises a housing unit 14*b* having a flux-conducting element 15*b*, which is provided to conduct a magnetic flux generated by the magnetic actuator. The flux-conducting element 15*b* is in a mounted state arranged between the pump spring 13*b* and the piston guidance 11*b* in a radial direction. The pump spring 13*b* is arranged directly neighboring to the flux-conducting element 15*b* in a radial direction. The flux-conducting element 15*b* comprises a base body 18*b*, which is embodied as a hollow cylinder and has an outer wall 17*b*. The flux-conducting element 15*b* is arranged in the prechamber 32*b* of the oscillating armature pump 10*b* on an inlet-side directly neighboring in an axial direction to the housing element 24*b* which is embodied as an inlet element. The piston guidance 11*b* and the flux-conducting element 15*b* are connected in a friction-fit manner. The piston guidance 11*b* comprises an inner wall 16*b*. The inner wall 16*b* of the piston guidance 11*b* and the outer wall 17*b* of the flux-conducting element 15*b* are situated adjacently to each other. The flux-conducting element 15*b* has a pre-tension pressing, in a mounted state, the outer wall 17*b* of the flux-conducting element 15*b* against the inner wall 16*b* of the piston guidance 11*b*.

The flux-conducting element 15*b* comprises at a front-side edge three feet 19*b*, 20*b*, 21*b*, which partly form an inlet-side spring seat of the pump spring 13*b*. The feet 19*b*, 20*b*, 21*b* each implement a fixating element. The feet 19*b*, 20*b*, 21*b* are provided to fixate the flux-conducting element 15*b* in an axial direction. In a mounted state the edge provided with the feet 19*b*, 20*b*, 21*b* faces the inlet of the oscillation armature pump 10*b*. The pump spring 13*b* is in contact with the feet 19*b*, 20*b*, 21*b* of the flux-conducting element 15*b* and presses the flux-conducting element against the inlet element, towards the inlet. In the present embodiment the feet 19*b*, 20*b*, 21*b* are implemented as tongues protruding beyond the base body 18*b* on an inlet side (cf. FIG. 4). The flux-conducting element 15*b* comprises, at the edge featuring the feet 19*b*, 20*b*, 21*b*, and respectively directly next to the feet 19*b*, 20*b*, 21*b*, respectively two U-notches 59*b*, 60*b*, 61*b*, 62*b*, 63*b*, 64*b*. The feet 19*b*, 20*b*, 21*b* and the U-notches 59*b*, 60*b*, 61*b*, 62*b*, 63*b*, 64*b* are arranged analogously to each other. The feet 19*b*, 20*b*, 21*b* are arranged in such a way that they are evenly distributed over a circumference of the flux-conducting element 15*b* at an angular distance of 120 degrees. The feet 19*b*, 20*b*, 21*b* are oriented inwards in a radial direction with respect to the base body 18*b*. The feet 19*b*, 20*b*, 21*b* are bent inwards in the radial direction. The flux-conducting element 15*b* comprises a straight slot 22*b* in an axial direction. The slot 22*b* is embodied end-to-end in an axial and in a radial direction.

In contrast to the previous exemplary embodiment, the oscillating armature pump 10*b* comprises a further flux-conducting element 23*b*, which is arranged radially inside the pump spring 13*b*. The pump spring 13*b* is arranged directly neighboring to the further flux-conducting element 23*b* in a radial direction. The further flux-conducting element 23*b* comprises a base body 25*b*, which is embodied as a hollow cylinder and comprises an inner wall 76*b*. The flux-conducting element 23*b* is arranged in the prechamber 32*b* of the oscillating armature pump 10*b* on an inlet side, directly neighboring to the housing element 24*b*, which is embodied as an inlet element, in an axial direction. The flux-conducting elements 15*b*, 23*b* have a common axial extension and are arranged completely overlapping one another in an axial direction. The flux-conducting elements 15*b*, 23*b* at least partly encompass in a mounted state the pump spring 13*b* between them in a radial direction. The pump spring 13*b* is arranged between the two flux-conducting elements 15*b*, 23*b* with a clearance in a radial direction.

In an idle state the pump spring 13*b* is arranged between the flux-conducting elements 15*b*, 23*b* by approximately 45% of its longitudinal extension.

The further flux-conducting element 23*b* is provided to conduct a magnetic flux generated by the magnetic actuator. The further flux-conducting element 23*b* is provided to vary a distribution of the magnetic field in the inner pump space in a vicinity of a turning point between a compression stroke and an intake stroke of the piston element 12*b*, and to attract the piston element 12*b* magnetically. The further flux-conducting element 23*b* is implemented of a magnetizable material. In the present exemplary embodiment the flux-conducting element 23*b* is implemented of a magnetizable stainless steel.

The further flux-conducting element 23*b* comprises at a front-side edge three feet 26*b*, 27*b*, 28*b*, which partly form an inlet-side spring seat of the pump spring 13*b*. Principally it is conceivable that the further flux-conducting element 23*b* has a greater number of feet. In a mounted state the edge featuring the feet 26*b*, 27*b*, 28*b* faces towards the inlet of the oscillating armature pump 10*b*. The pump spring 13*b* is in contact with the feet 26*b*, 27*b*, 28*b* of the flux-conducting element 23*b* and presses the flux-conducting element 23*b* against the housing element 24*b*, which is embodied as an inlet element, towards the inlet. The feet 26*b*, 27*b*, 28*b* are in the present embodiment implemented as tongues and protrude beyond the base body 25*b* on an inlet side. The flux-conducting element 23*b* comprises at the edge featuring the feet 26*b*, 27*b*, 28*b* and respectively directly next to the feet 26*b*, 27*b*, 28*b* respectively two U-notches 66*b*, 67*b*, 68*b*, 69*b*, 70*b*, 71*b*. The feet 26*b*, 27*b*, 28*b* and the U-notches 66*b*, 67*b*, 68*b*, 69*b*, 70*b*, 71*b* are embodied respectively analogously to each other. The feet 26*b*, 27*b*, 28*b* are arranged distributed evenly over a circumference of the flux-conducting element 23*b* at an angular distance of 120 degrees. The feet 26*b*, 27*b*, 28*b* are oriented outwards in a radial direction with respect to the base body 25*b*. The feet 26*b*, 27*b*, 28*b* are bent outwards in the radial direction. In a mounted state the feet 19*b*, 20*b*, 21*b*, 26*b*, 27*b*, 28*b* of the two flux-conducting elements 15*b*, 23*b* are arranged respectively offset to each other in a circumferential direction. The feet 19*b*, 20*b*, 21*b*, 26*b*, 27*b*, 28*b* of the flux-conducting elements 15*b*, 23*b* alternate with each other in the circumferential direction. The prechamber 32*b* comprises an inlet-side front wall which is in contact with the feet 19*b*, 20*b*, 21*b*, 26*b*, 27*b*, 28*b* of the flux-conducting elements 15*b*, 23*b*. The housing element 24*b* which is embodied as an inlet element implements the inlet-side front wall of the prechamber 32*b*.

The further flux-conducting element 23*b* is embodied as a piece of sheet metal, which is rolled forming a sleeve. The base body 25*b* has an outer diameter, and a wall thickness which amounts to approximately 12% of the outer diameter. The wall thickness of the flux-conducting element 23*b* is in the present exemplary embodiment approximately 1 mm. The flux-conducting element 23*b* comprises a straight slot 72*b* in an axial direction. The slot 72*b* is implemented end-to-end in an axial and a radial direction.

In contrast to the previous exemplary embodiment, the housing element 24*b*, which is embodied as an inlet element, comprises a fitting 73*b* provided for holding the further flux-conducting element 23*b*. The fitting 73*b* of the housing element 24*b* prolongates the connecting fitting 37*b* of the housing element 24*b* and forms, together with the connecting fitting 37*b*, an inlet channel 74*b*. The fitting 73*b* protrudes into a pump interior. The fitting 73*b* of the housing element 24*b* protrudes into the prechamber 32*b*. The fitting 73*b* of the housing element 24*b* and the further flux-conducting element 23*b* are connected to each other in a friction-fit fashion. The fitting 73*b* comprises an outer wall 75*b*. The outer wall 75*b* of the fitting 73*b* and an inner wall 76*b* of the further flux-conducting element 23*b* are situated adjacently to each other. The flux-conducting element 23*b* has a pre-tension which, in a mounted state, presses the inner wall 76*b* of the flux-conducting element 23*b* against the outer wall 75*b* of the fitting 73*b*.

FIGS. 5 and 6 show an oscillating armature pump 10*c* comprising, analogously to the preceding exemplary embodiment, a magnetic actuator featuring a magnetic coil 29*c*, a coil housing 30*c* and a piston element 12*c*. The oscillating armature pump 10*c* further comprises a pump spring 13*c* acting onto the piston element 12*c*, and a damper spring 31*c*. Moreover the oscillating armature pump 10*c* comprises a piston guidance 11*c* extending through the coil housing 30*c* with the magnetic coil 29*c* and encompassing an inner pump space in which the piston element 12*c* is guided in an axially mobile fashion. The piston element 12*c* comprises a ring-shaped groove 33*c* forming an outlet-side spring seat of the pump spring 13*c*. The magnetic coil 29*c* is provided to generate a magnetic field which partly permeates the inner pump space. For directing the magnetic field, the magnetic actuator comprises two pole piece elements 34*c*, 35*c*, between the ends of which a magnetically insulating gap 36*c* is arranged.

The oscillating armature pump 10*c* comprises, analogously to the preceding exemplary embodiments, a housing element 24*c* embodied as an inlet element, which is provided for a connection of a feed line for the liquid that is to be conveyed. The housing element 24*c* comprises a connecting fitting 37*c* and a flange body 38*c*. In the present exemplary embodiment the inlet element is implemented integrally with the piston guidance 11*c*. The oscillating armature pump 10*c* further comprises an outlet element 39*c*, which is provided for a connection of an output line for the liquid that is to be conveyed. The outlet element 39*c* comprises a pressure chamber cylinder 40*c* and a flange body 41*c*. The oscillating armature pump 10*c* further comprises a sealing disk 42*c*, which delimits the inner pump space on an outlet side and forms an outlet-side front area of the inner pump space. The sealing disk 42*c* is arranged between the piston guidance 11*c* and the outlet element 39*c* in an axial direction and is, in a mounted state, inserted in the flange body 38*c* of the outlet element 39*c*. The pressure chamber cylinder 40*c* implements a cylindrical pressure chamber 43*c* and has a necking 44*c* dividing the pressure chamber 43*c* into a compression chamber 45*c* and a valve chamber 46*c*. The necking 44*c* protrudes into the pressure chamber 43*c* in a radial direction. The oscillating armature pump 10*c* comprises an outlet valve 47*c*, which is arranged in the valve chamber 46*c* of the outlet element 39*c*. The outlet valve 47*c* comprises an axially movably supported closure piece 48*c* and a closure spring 49*c* which, in a mounted state, presses the closure piece 48*c* against the valve seat.

The piston guidance 11*c* is embodied, analogously to the preceding exemplary embodiments, as an elongate cylinder. The oscillating armature pump 10*c* comprises a prechamber 32*c*, which is in the present exemplary embodiment encompassed by the piston guidance 11*c*. The piston element 12*c* comprises an armature element 50*c* and a pressure piston element 51*c* as well as a transition element 52*c* which connects the armature element 50*c* to the pressure piston element 51*c*. The piston element 12*c* has, in a vicinity of the transition element 52*c*, two cut-outs 53*c* which are provided for a liquid exchange between the two axial sides of the armature element 50*c*. The pressure piston element 51*c* comprises a piston valve 54*c* arranged, in terms of flow, between the prechamber 32*c* and the compression chamber 45*c*. The piston valve 54*c* comprises a closure piece 55*c* and a closure spring 56*c*. The closure piece 55*c* is arranged at an outlet-side end of the pressure piston element 51*c*. The outlet element 39*c* comprises a sealing region 57*c* in a transition zone between the prechamber 32*c* and the compression chamber 45*c*. The sealing region 57*c* comprises a sealing element 58*c* which is provided for sealing an inner wall of the pressure chamber cylinder 40*c* against an outer wall of the pressure piston element 51*c* and for sealingly closing off the compression chamber 45*c* against the prechamber 32*c*.

Analogously to the previous exemplary embodiment the oscillating armature pump 10*c* comprises a housing unit 14*c* featuring a flux-conducting element 15*c* which is provided to conduct a magnetic flux generated by the magnetic actuator. The flux-conducting element 15*c* is in a mounted state arranged in a radial direction between the pump spring 13*c* and the piston guidance 11*c*. The pump spring 13*c* is arranged directly neighboring to the flux-conducting element 15*c* in a radial direction. The flux-conducting element 13*c* comprises a base body 18*c* which is embodied as a hollow cylinder, and has an outer wall 17*c*. The flux-conducting element 15*c* is arranged in the prechamber 32*c* of the oscillating armature pump 10*c* on an inlet side, directly neighboring, in an axial direction, to the housing element 24*c*, which is embodied as an inlet element. The piston guidance 11*c* and the flux-conducting element 15*c* are connected to each other in a friction-fit fashion. The piston guidance 11*c* has an inner wall 16*c*. The inner wall 16*c* of the piston guidance 11*c* and the outer wall 17*c* of the flux-conducting element 15*c* are situated directly adjacently to each other. The flux-conducting element 15*c* has a pretension which, in a mounted state, presses the outer wall 17*c* of the flux-conducting element 15*c* against the inner wall 16*c* of the piston guidance 11*c*.

In contrast to the preceding exemplary embodiments, the flux-conducting element 15*c* comprises a fixating element 77*c*, 78*c*, 79*c*. The flux-conducting element 15*c* comprises a plurality of fixating elements 77*c*, 78*c*, 79*c*. The flux-conducting element 15*c* comprises three fixating elements 77*c*, 78*c*, 79*c*. The fixating elements 77*c*, 78*c*, 79*c* are provided for holding the flux-conducting element 15*c* in the piston guidance 11*c*. The fixating elements 77*c*, 78*c*, 79*c* are provided for supplying a holding force in an axial direction. The fixating elements 77*c*, 78*c*, 79*c* are provided for supplying a holding force in an inlet direction. The fixating elements 77*c*, 78*c*, 79*c* are arranged in a region of a front-side edge of the flux-conducting element 15*c*. The fixating elements 77*c*, 78*c*, 79*c* are provided to implement a force-fit connection to the housing element 24*c* which is embodied as an inlet element. The fixating elements 77*c*, 78*c*, 79*c* are provided to implement a form-fit connection to the housing element 24*c* which is embodied as an inlet element. The fixating elements 77*c*, 78*c*, 79*c* respectively protrude in a radial direction inwards beyond an inner surface of the flux-conducting element 15*c*. In a mounted state the edge featuring the fixating elements 77*c*, 78*c*, 79*c* faces toward the inlet of the oscillating armature pump 10*c*. The fixating elements 77*c*, 78*c*, 79*c* are arranged evenly distributed in a circumferential direction. The fixating elements 77*c*, 78*c*, 79*c* have an angular distance of approximately 120 degrees. the flux-conducting element 15*c* comprises a straight slot 22*c* in an axial direction. The slot 22*c* is embodied as a gap extending end-to-end in an axial and in a radial direction.

The fixating elements 77*c*, 78*c*, 79*c* are embodied integrally with the flux-conducting element 15*c*. The fixating elements 77*c*, 78*c*, 79*c* are implemented of a material of the flux-conducting element 15*c*. The fixating elements 77*c*, 78*c*, 79*c* are formed from a wall of the flux-conducting element 15*c*. The fixating elements 77*c*, 78*c*, 79*c* are embodied as clamping elements. The fixating elements 77*c*, 78*c*, 79*c* are provided for supplying a clamping force between the flux-conducting element 15*c* and the housing element 24*c* which is embodied as an inlet element. The fixating elements 77*c*, 78*c*, 79*c* are implemented as clamping tongues. The fixating elements 77*c*, 78*c*, 79*c* have barbed hooks. In a mounted state, the fixating elements 77*c*, 78*c*, 79*c* are respectively in contact with a notch of the housing element 24*c* caused by the respective clamping tongue. The fixating elements 77*c*, 78*c*, 79*c* each have a free end protruding in a radial direction inwards beyond an inner surface of the flux-conducting element 15*c*. The fixating elements 77*c*, 78*c*, 79*c* are arranged at an acute angle with respect to the inner surface of the flux-conducting element 15*c*. The fixating elements 77*c*, 78*c*, 79*c* each have a longitudinal edge including an angle of less than 10 degrees with the inner surface of the flux-conducting element 15*c*. The flux-conducting element 15*c* has respectively one depression in a vicinity of the fixating elements 77*c*, 78*c*, 79*c* on an outer surface.

The housing element 24*c* embodied as an inlet element comprises a fitting 73*c*. The fitting 73*c* of the housing element 24*c* prolongates the connecting fitting 37*c* of the housing element 24*c* and forms, together with the connecting fitting 37*c*, an inlet channel 74*c*. The fitting 73*c* protrudes into the pump interior. The fitting 73*c* of the housing element 24*c* protrudes into the prechamber 32*c*. The housing element 24*c* embodied as an inlet element comprises a holding ring 80*c*. The holding ring 80*c* protrudes into the pump interior. The holding ring 80*c* of the housing element 24*c* protrudes into the prechamber 32*c*. The holding ring 80*c* is arranged concentrically to the motion axis of the piston element 12*c*. The holding ring 80*c* is arranged radially between the fitting 73*c* and the inner wall 16*c* of the piston guidance 11*c*. The holding ring 80*c* is implemented integrally with the housing element 24*c*, which is embodied as an inlet element. A free front surface of the holding ring 80*c* partly forms a spring seat of the pump spring 13*c*.

The oscillating armature pump 10*c* comprises a ring-shaped groove 81*c*, which is provided to receive the flux-conducting element 15*c*. The groove 81*c* is arranged radially between the inner wall 16*c* of the piston guidance 11*c* and the holding ring 80*c* of the housing element 24*c*. In a mounted state, the flux-conducting element 15*c* engages into the groove 81*c*. The fixating elements 77*c*, 78*c*, 79*c* of the flux-conducting element 15*c* are provided to establish a force-fit connection to the holding ring 80*c*. In a mounted state, the free ends of the fixating elements 77*c*, 78*c*, 79*c* are in contact with the holding ring 80*c* of the housing element 24*c*. The groove 81*c* has an aperture the width of which corresponds to a wall thickness of the flux-conducting element 15*c*.

The invention claimed is:

1. An oscillating armature pump for a household appliance, with a piston guidance for guiding a piston element, with a pump spring provided for supplying an actuation force onto the piston element, and with a housing unit comprising at least one flux-conducting element which is provided to conduct a magnetic flux generated by a magnetic actuator, wherein the flux-conducting element is in a mounted state arranged in a radial direction between the pump spring and the piston guidance, wherein the flux-conducting element comprises a base body which has an outer diameter, and a wall thickness amounting to maximally 10% of the outer diameter, and a plurality of feet which form at least partly a spring seat of the pump spring.

2. The oscillating armature pump as claimed in claim 1, wherein the piston guidance and the flux-conducting element are connected in a friction-fit manner.

3. The oscillating armature pump as claimed in claim 1, wherein the piston guidance comprises an inner wall, and the flux-conducting element comprises an outer wall which are situated adjacently to each other.

4. The oscillating armature pump as claimed in claim 1, wherein the feet are oriented inwards in a radial direction with respect to the base body.

5. The oscillating armature pump as claimed in claim 1, wherein the housing unit comprises a further flux-conducting element, which is arranged radially inside the pump spring.

6. The oscillating armature pump as claimed in claim 5, wherein the flux-conducting elements at least partially enclose the pump spring between them in a radial direction.

7. The oscillating armature pump at least as claimed in claim 5, wherein the housing unit comprises a housing element, which is connected to the further flux-conducting element in a friction-fit manner.

8. The oscillating armature pump at least as claimed in claim 5, wherein the further flux-conducting element comprises a base body and a plurality of feet, which form at least partly a spring seat of the pump spring.

9. The oscillating armature pump as claimed in claim 8, wherein the feet are oriented outwardly in a radial direction with respect to the base body.

10. The oscillating armature pump as claimed in claim 1, wherein the flux-conducting element comprises at least one fixating element, which is provided for holding the flux-conducting element in the piston guidance.

11. The oscillating armature pump as claimed in claim 10, wherein the at least one fixating element is embodied integrally with the flux-conducting element.

12. The oscillating armature pump at least as claimed in claim 10, wherein the at least one fixating element is embodied as a clamping element.

13. The oscillating armature pump as claimed in claim 1, further comprising a ring-shaped groove provided for receiving the flux-conducting element.

14. A method for manufacturing an oscillating armature pump for a household appliance, with a piston guidance for guiding a piston element, with a pump spring provided for supplying an actuation force onto the piston element, and with a housing unit comprising at least one flux-conducting element which is provided to conduct a magnetic flux generated by a magnetic actuator, comprising:

bending and rolling up a piece of sheet metal, forming a sleeve to embody the flux-conducting element, in such a way that the flux-conducting element comprises at least one slot in an axial direction, and mounting the flux-conducting element in such a way that it is arranged in a radial direction between the pump spring and the piston guidance.

15. An oscillating armature pump for a household appliance, with a piston guidance for guiding a piston element, with a pump spring provided for supplying an actuation force onto the piston element, and with a housing unit comprising at least one flux-conducting element which is provided to conduct a magnetic flux generated by a magnetic actuator, wherein the flux-conducting element is in a mounted state arranged in a radial direction between the pump spring and the piston guidance, wherein the housing unit comprises a further flux-conducting element, which is arranged radially inside the pump spring, and wherein the flux-conducting elements at least partially enclose the pump spring between them in a radial direction.

16. An oscillating armature pump for a household appliance, with a piston guidance for guiding a piston element, with a pump spring provided for supplying an actuation force onto the piston element, and with a housing unit comprising at least one flux-conducting element which is provided to conduct a magnetic flux generated by a magnetic actuator, wherein the flux-conducting element is in a mounted state arranged in a radial direction between the pump spring and the piston guidance, wherein the housing unit comprises a further flux-conducting element, which is arranged radially inside the pump spring, and wherein the housing unit comprises a housing element, which is connected to the further flux-conducting element in a friction-fit manner.

17. An oscillating armature pump for a household appliance, with a piston guidance for guiding a piston element, with a pump spring provided for supplying an actuation force onto the piston element, and with a housing unit comprising at least one flux-conducting element which is provided to conduct a magnetic flux generated by a magnetic actuator, wherein the flux-conducting element is in a mounted state arranged in a radial direction between the pump spring and the piston guidance, wherein the housing unit comprises a further flux-conducting element, which is arranged radially inside the pump spring, wherein the further flux-conducting element comprises a base body and a plurality of feet, which form at least partly a spring seat of the pump spring, and wherein the feet are oriented outwardly in a radial direction with respect to the base body.

* * * * *